US007100541B2

(12) United States Patent
Frasure et al.

(10) Patent No.: US 7,100,541 B2
(45) Date of Patent: Sep. 5, 2006

(54) HIGH EFFICIENCY TANK TYPE CONTINUOUS FLOW AND SELF CLEANING WATER HEATER

(76) Inventors: Charles J. Frasure, 170 Park St., Blackfoot, ID (US) 83221; Greg A. Frasure, 170 Park St., Blackfoot, ID (US) 83221; Paul J. Frasure, 170 Park St., Blackfoot, ID (US) 83221; Blake D. Frasure, 1830 Rainier Dr., Pocatello, ID (US) 83201

( * ) Notice: Subject to any disclaimer, the term of this patent is extended or adjusted under 35 U.S.C. 154(b) by 0 days.

(21) Appl. No.: 10/994,627

(22) Filed: Nov. 22, 2004

(65) Prior Publication Data

US 2005/0109287 A1 May 26, 2005

Related U.S. Application Data

(60) Provisional application No. 60/524,312, filed on Nov. 21, 2003.

(51) Int. Cl.
*F22B 7/00* (2006.01)

(52) U.S. Cl. ..... 122/159; 122/155.2; 122/44.2; 122/160

(58) Field of Classification Search ..... 122/159, 122/155.1, 155.3, 166.2, 174, 188, 201, 380, 122/388, 383, 384, 390, 399, 402, 183, 44.2, 122/160, 162; 126/387.1; 138/8
See application file for complete search history.

(56) References Cited

U.S. PATENT DOCUMENTS

| | | | | |
|---|---|---|---|---|
| 1,016,398 | A * | 2/1912 | Burroughs | 122/18.4 |
| 1,632,888 | A * | 6/1927 | Davis et al. | 122/159 |
| 2,642,046 | A * | 6/1953 | Alexander | 122/15.1 |
| 4,356,794 | A * | 11/1982 | Bouman et al. | 122/158 |
| 4,662,350 | A * | 5/1987 | Mossbach | 126/101 |
| 4,702,226 | A * | 10/1987 | Shelley | 122/18.2 |
| 6,508,208 | B1 * | 1/2003 | Frasure et al. | 122/388 |

* cited by examiner

*Primary Examiner*—Gregory Wilson

(57) ABSTRACT

A water heater comprising a closed tank having a water inlet for connection with a water supply, and a hot water outlet connected to the tank interior; a flue pipe extending vertically through the tank and having an upper portion for connection with a vent pipe; a cylinder having a lower end and upper open end with means for opening disposed within the flue pipe, and spaced from inner walls of the flue pipe, and extending substantially the length of the flue pipe; a burner disposed in a lower region of the cylinder and above the lower end thereof, such that combustion products from the burner rise through the cylinder; and a water conducing coil disposed within the cylinder connected with the interior of the tank.

22 Claims, 2 Drawing Sheets

HIGH EFFICIENCY TANK TYPE CONTINUOUS FLOW AND SELF CLEANING WATER HEATER

This application claims priority benefits under 35USC Declaration 119(e) of U.S. Provisional Patent Application No. 60/524,312 Filed Nov. 21, 2003.

The present invention is an improvement on the invention disclosed in U.S. Pat. No. 6,508,208 issued Jan. 31, 2003, to Frasure, et al.

FIELD OF THE INVENTION

This invention relates generally to water heaters, and specifically to water heaters having increased heating efficiency, provision for producing continuous flow and preventing substantial accumulation of sediment by introducing a self-cleaning mechanism, and to a method of operating the same.

BACKGROUND OF THE INVENTION

Applicants prior U.S. Pat. No. 6,508,208 issued Jan. 31, 2003, to Frasure, et al. discloses a water heater, for which the present invention provides improvements.

Reames, Jr., U.S. Pat. No. 4,175,518 dated 27, Nov. 1979, discloses a preheating device for hot water heaters, which employs hot gases of combustion from the flue to preheat incoming cold water and to continually preheat water stored in the water tank by natural recirculation. Use of the device provides for increased fuel efficiency because hot combustion gases from the heat source are used for warming of water before venting to the atmosphere, the result being an average increased temperature within the tank so that lesser amounts of fuel are required to reach any desired hot water temperature.

Leiter Klaus and Walder Gerhar, PCT Publication No. WO0113045 dated 22, Feb. 2001, discloses a sanitation unit having a hot water boiler and a water treatment unit with a functional element, in particular for the prevention of deposits of scale, whereby a circulation pump is provided, through which water taken from the hot water connection of the boiler can be routed through the functional element to the water treatment unit of the cold water connection of the boiler. The circulation pump and the functional element are constructed as one compact structural unit.

Burwell, U.S. Pat. No. 2,549,755 dated 24, Apr. 1951, discloses a burner base for a hot water tank of the type having a side arm heat-transfer coil carried within a chamber disposed adjacent the tank and means defining a flue passage in said base and communicating, respectively with the said open chamber and the chamber in which the heat-transfer coil of the said tank is carried, whereby gaseous products of combustion emanating from said burner may be directed from the bottom of said tank to the heat transfer coil thereof.

All the water heaters utilizing a coil that were found in the prior art relied on natural convection to circulate water through the coil. As a result, the coil can become overheated and get damaged when the burner is operating. None of the aforesaid prior arts teaches for increasing the efficiency by controlling the condensation problem. The condensation problem is solved by keeping the water vapor produced by the flame away from the cooler flue wall and by utilizing the hot air many a times by circulation of the same keeping safety and atomization of the system in mind. Moreover none of the prior arts also teaches a self-cleaning mechanism of tank and the coils used by the system. Hence, the prior art devices do-not appear to substantially use the waste heat energy and prevent the accumulation of the sediments, despite claims to the contrary.

SUMMARY OF THE INVENTION

It is an object of the present invention to provide an improved highly efficient, tank type, water heater.

A specific object of the present invention is to reduce condensation in the coil and the flue pipe.

Another object is to provide means to prevent overheating of the system.

Another object of one embodiment of the present invention is to provide means for instant and continuous flow of hot water.

Another object of the present invention is to provide means for self cleaning components of the system.

It has been found that improvements can be made to water heaters, such as providing an increase in the efficiency of heating, providing a continuous supply of water, and providing self cleaning of the water heater, and that these improvements can be obtained by using principle of conservation of heat energy by several means, and with the use of attachments.

The present invention provides a water heater comprising a closed tank having a water inlet for connection with a water supply, and a hot water outlet connected to the tank interior; a flue pipe extending vertically through the tank and having an upper portion for connection with a vent pipe; a cylinder having a lower and upper open end disposed within the flue pipe, and spaced from inner walls of the flue pipe, and extending substantially the length of the flue pipe; a burner disposed in a lower region of the cylinder and above the lower end thereof, such that combustion products from the burner rise through the cylinder; and a water conducing coil disposed within the cylinder connected with the interior of the tank.

DESCRIPTION OF THE PREFERRED EMBODIMENTS

Figure 1:
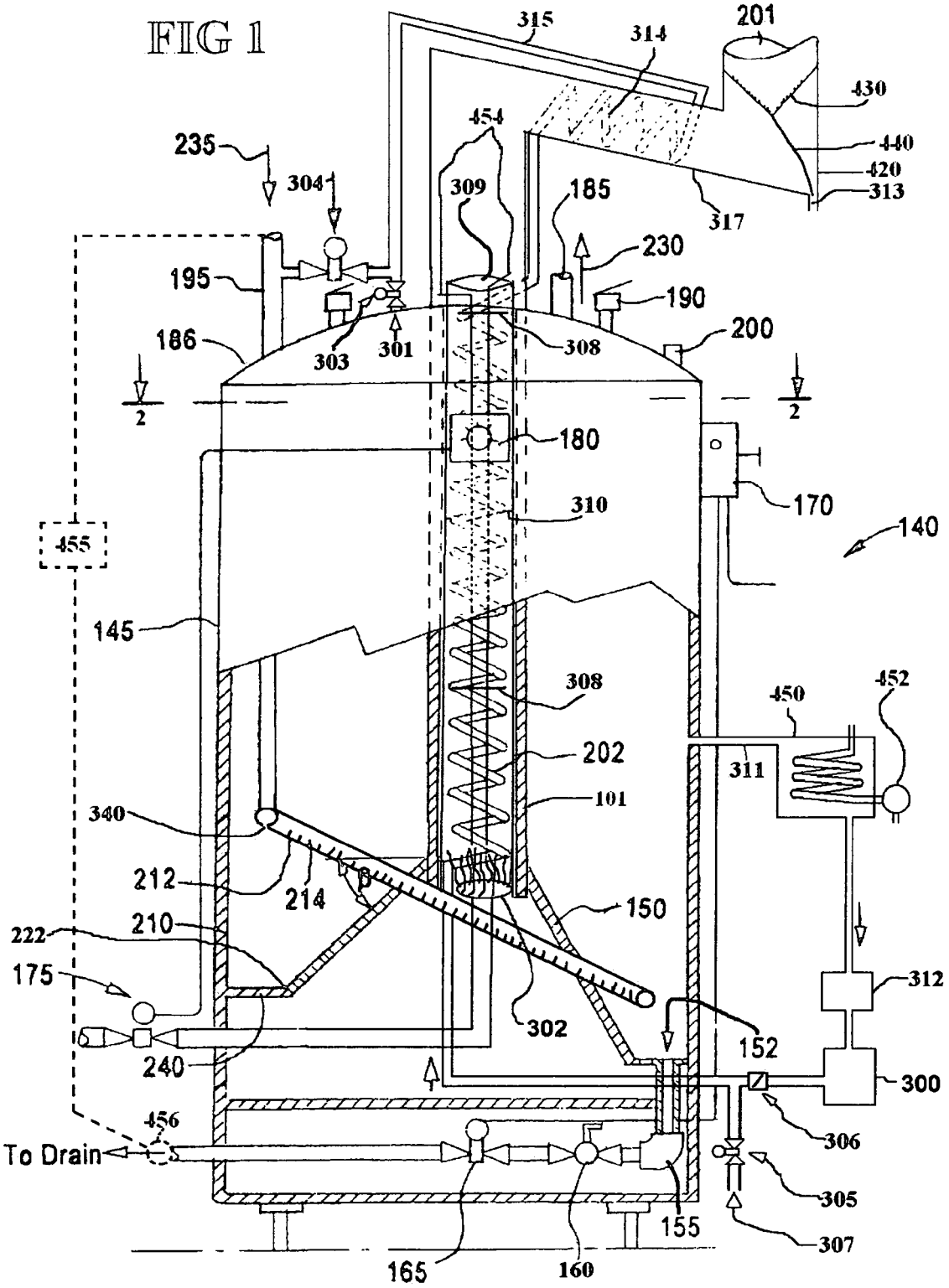
FIG. 1 is a partly sectioned front elevation view and section view of the gas-fired water heater of the present invention.
Figure 2:
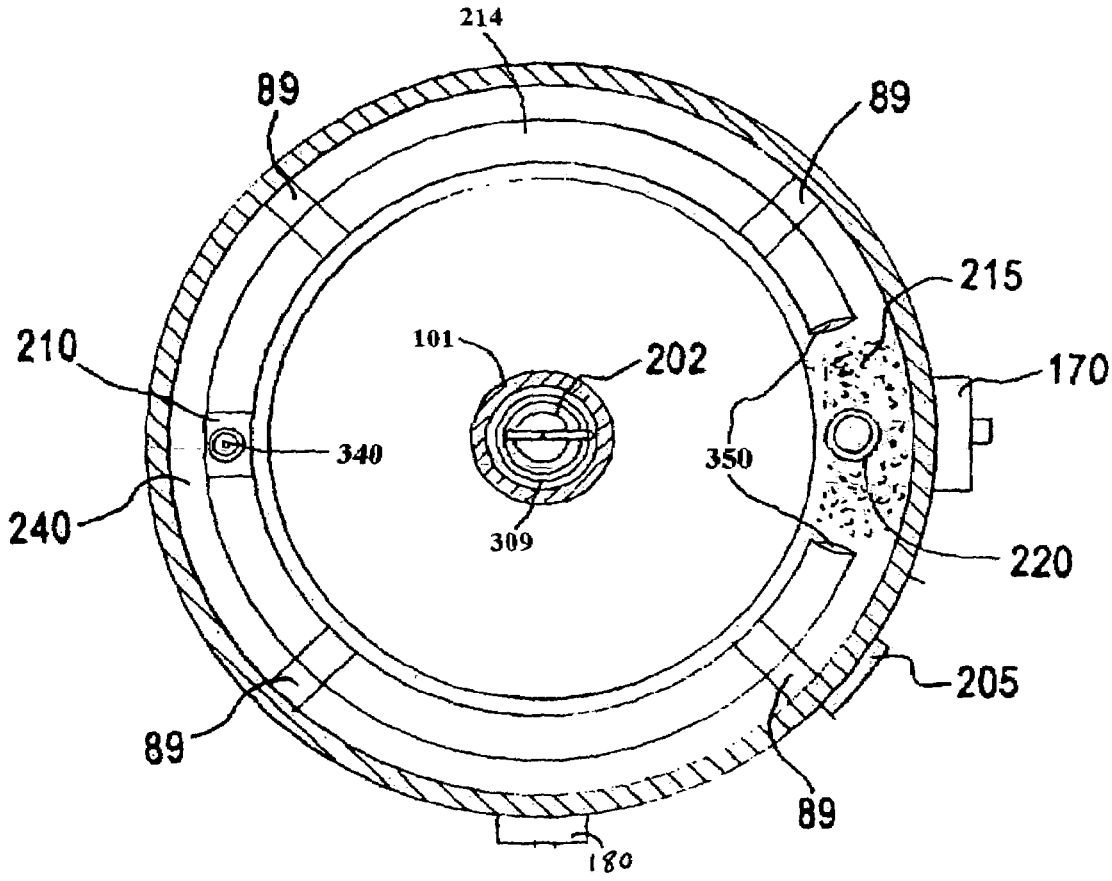
FIG. 2 is a sectional view taken along lines 2—2 of FIG. 1.

With reference to FIGS. 1 and 2, the water heater of the present invention comprises a a tank 140 having a water inlet 235 for connection with a water supply, and a hot water outlet 307 connected with the tank interior. A flue pipe 101 extends vertically through the tank and has an upper portion for connection with a vent pipe 201. A cylinder 309 having a lower end and an upper end with means for opening is disposed within the flue pipe 101, and spaced from inner walls of the flue pipe, and extends substantially the length of the flue pipe. A burner 302 is disposed in a lower region of the cylinder 309 and above the lower end thereof, such that combustion products from the burner rise through the cylinder. A water conducing coil 202 disposed within the cylinder connects with the interior of the tank.

Preferably, the coil 202 has valve means 301 and 304 at its upper end for selectively connecting with the interior of the tank 140 or with the water supply, and valve means 305 and 306, at the lower end, for selectively connecting with the interior the tank or to a drain 307. Control means activate the valve means, such that in one selected activated state heat from the flue pipe is transferred from the coil to the water in the tank, and in another activated state water from the water supply is directed through the coil, immediately after burner shut-off, providing thermal shock to dislodge deposits from the inside walls of the coils for disposing to the drain.

As shown in FIG. 1, the tank 140 has a cylindrical wall 145 and the lower section includes an inverted conical wall 150 having a minimum downward slope angle β of at least 42 degrees from the horizontal for optimum operation. Drain 152, at the bottom of inverted cone 150, is adjacent to elbow 155, connected to manual ball valve 160, in turn connected to automatic solenoid operated drain valve 165. Drain valve 165 is actuated by timer/controller 170, which is adjusted to control the valve opening duration, and the time of day the valve is required to be opened.

In one embodiment of the invention, the water heater system includes a pump, a thermostat, and a flow sensor, wherein the pump is responsive to the thermostat, and the burner is responsive to flow detected by the flow sensor.

The water heater temperature is set by gas control valve 175, a gas burner 302, which is located inside the bottom of the cylinder and adjustable temperature controller 180. The gas burner is placed one inch above from the bottom of the cylinder to preclude any water contact with the flame. For clarity, the drawing does not show heater insulation, which covers all sections of the heater and hot water outlet pipe 185. Penetrating the heater top section 186 are pressure and temperature relief valves 190, cold-water inlet pipe 195, and corrosion reducing anode 200.

The coil 202 is located inside a cylinder 309 and extends substantially the full length of the portion of the flue 101 that is disposed within the tank 140. The cylinder 309 is sized to leave a space (about ¼ inch) between the cylinder wall and the flue wall. This distance is preferable, but other distances in this range will work. The area between the top of the coil and the flue could be covered with a ¼ inch wide flange.

The burner is placed inside the cylinder approximately one inch from the bottom of the cylinder. This prevents steam or water to flow in the direction of flame or entering the area between the flue and the cylinder. The flow of the steam/hot gases is so directed that no flow is directed towards the bottom of the water tank. This inturn results in the lowering of the temperature of the bottom of the tank and thereby significantly reducing/preventing the ability of the minerals present in the water to adhere to the bottom surfaces of the tank and flue. The bottom of the tank and flue thus becomes free from the hard water sediments which is a solution of a major problem in the water tanks in areas where the water contains many types of minerals. The heat transfer efficiency of the system is improved and the problem of overheating of the bottom of the water tank is thus eliminated and also enhances the life of the tank.

In one embodiment the area between the top of the flue and cylinder is to be sealed and the area between the flue and the cylinder would preferably contain upwardly pointing perforations. This would allow for the heat flow to be controlled. Any condensation, if there is any being trapped and drained at that point if necessary. There is a ¼" gap between the top of the flue pipe and the top of the cylinder. The gap would preferably be fitted with a ring which could contain upwardly pointing perforations to allow appropriate heat flow, but prevent any condensation if there is any to be collected and drained at that point. The diameter of the cylinder may even be reduced at the top if necessary to allow room for an appropriate size drain to be connected to a dram tube leading to the outside of the water heater.

To solve the condensation problem in the flue, the coil is enclosed in a cylinder 309, which runs full length of the flue portion 401 within the tank. This also increases the efficiency. The cylinder would preferably be attached to the top of area of the flue. The flue in the prototype extends approximately one inch above the top surface of the tank. A person skilled in the art can very well evaluate the disadvantages of the condensation of the steam and hot gases in the coil/cylinder.

The temperature at the top of the primary coil is approximately 200 degrees F. To further take advantage of the heat, a second coil 314 is added to further increase the efficiency and also causes the condensation to collect on the coil and exit through the drain 313 below. The second coil is located in the generally horizontal or transverse section 317 of vent pipe 201. This coil is cooler than the heat flow venting up the stack, which causes the water to condense on the coil and drain at 313. The coil also absorbs a significant portion of the remaining heat in the vent pipe at that point, which inturn increases the efficiency. The transverse section 317 is preferably slanted downward, which allows the condensate to collect at the drain 313. The wall of transverse section 317 and area around drain 313 would be coated with a non-corrosive material to prevent deterioration of the vent pipe. The internal wall of the total area of the vent pipe 201 could be coated with a non-corrosive material or the vent pipe 201 could be made of a material such as PVC, CPVC, or stainless steel that would accommodate the necessary temperatures and not deteriorate.

The lower coils of the coil in the present case are larger than the coils in the upper portion of the coil as a result of the coils. This pulls the bulk of the heat out of the air at the bottom verses at the top where condensation could occur as a result of cooler temperatures.

In one embodiment of present invention a third coil may be included and fitted around the outside of the cylinder between the cylinder wall and the flue wall. The coil would tie into the bottom of the primary coil via a tee and at the top of the primary coil via a tee. There would be a 1/16th to a ¼ inch gap between the outside wall of the coil and the flue wall.

A steam trap 430 is preferably located just above the elbow 420. The trap could catch any condensate that may get past second coil 314. The drain 440 of the trap hangs down and drains into drain 313. The trap consists of a funnel with perforations protruding. The steam can pass upward, but it cannot get back through perforations and directed to the drain. The trap can be made of stainless steel or a material that will not deteriorate due to the acidic properties of the condensate such as PVC or CPVC. The steam trap may be located at different places in the coil system. In an economical model of the claimed water tank the steam trap may be located in the vent pipe above the coil 202 and the top of the cylinder for draining out the condensate through the side of the vent pipe via a tube running to the drain.

The gas burner used in the said water heater, as described earlier in the description, can be replaced by some electrical heating equipment as per the need and availability.

Flue pipe 309 penetrates the center of the top section 186 and extends down to the top of inverted cone 150. Handhold cover 205 provides access to the tank interior for manual cleaning and inspection.

A pump 450 is added to circulate the water through the system, which prevents the coil from overheating, significantly increases the efficiency and eliminates stacking.

Heat flow restrictors are strategically placed in the center and around the outside of the coil to force the heat from the burner through the coil. The lower inside restrictor 308 forces the heat flow through from the inside to the outside of the coil, the outer restrictor 310 located higher in the coil forces the heat flow from the outside of the coil to the inside of the coil. The restrictor 308 at the top of the coil forces the heat flow from the inside of the coil to the outside of the coil. This forces the heat through the fins of the coil and allows more of the heat to be transferred to the coil. Additional heat flow restrictors may be added based on the dimensions of the coil.

Line 311 can enter heat exchanger 450; the line then proceeds from heat exchanger 450 to filter 312. A circulation loop circulates through building from heat exchanger 450. The heat exchanger 450 contains a pump 452 for the hydronic circulation. The said attachment can be used separately in other water heaters for obtaining better results. When utilizing this embodiment, pump 300 and 452 could also be selectively activated by the thermostat of the building. In this embodiment, the burner would be activated by the thermostat of the tank, but would be unable to turn on unless the flow sensor detected water flow.

When the loop option is being utilized a check valve is required to be installed at the hot outlet line 185, preventing the water from being sucked back into the tank.

When the thermostat calls for heat in response to water being removed from the tank through hot water outlet 185, the thermostat turns the pump on. The pump creates water flow pass a flow sensor, the flow sensor then turns the burner on. If there is no water flow, the flame cannot come on. Water is then pumped through check valve 306, through primary coil 202, through leg 316 (316 can be located inside of outside of vent pipe), through secondary coil 314, through return line 315 (315 can be located in or outside of vent pipe, but preferably inside), 316 could also be located in the insulation under the sheet metal skin of the tank. The water continues its path through solenoid 303, into tank opening 301, out of tank into line 311 (311 may be utilized as a loop for hydronic heating) to filter 312 and into pump. All water lines outside the skin of the unit, filter and the water flow area of the pump would be adequately insulated. A manually reset high temperature limit switch is connected in the control circuit.

As a less preferred method, the water could flow in reverse counter flow during the recovery cycle.

The flue pipe 309 is located in the center of tank 140 therefore drain 152 cannot be centrally located. Consequently, drain 152 is located in proximity to exterior wall 145, at the lowest portion 220 of flange 240 that extends from the lowest edge of cone 150 and is bonded, e.g., by seam welding or soldering, to wall 145. Cone 150 forms a vertically and horizontally extending bottom wall portion of tank 140. The bottom edge of cone 150 has a zenith point 222 diametrically opposite from drain 152, which is at the nadir of the cone bottom edge. In each vertical cross section of tank 140, flange 240 extends horizontally between the bottom edge of cone 150 and wall 145. Flange 240 extends continuously and smoothly around the circumference of the bottom edge of cone 150, between zenith point 222 and drain 152 to, in effect, provide a runway for sediment incident on the flange and cone 150. The inclination angle β of the horizontally and vertically extending wall of cone 150 relative to the horizontal plane is such that washed sediment in tank 140 drifts by gravity along the wall of cone 150 to the runway flange 240 forms. Inclination angle β continuously varies from a minimum angle along a straight line of the wall segment between flue 201 and zenith point 222 to a maximum angle along a straight line of the wall segment between flue 201 and nadir 220. The inclination angle of the runway between zenith point 222 and drain 152 is such that the washed sediment incident on the runway also drifts by gravity to the drain. Experiments have shown that the optimum minimum inclination angle β is 42 degrees below a horizontal plane extending through a horizontal intersection of cone 150 and flue 201.

With reference to both FIGS. 1 and 2, the lowest end of dip tube 195 connects with manifold 212 for directing cold water generally horizontally in opposite directions. Manifold 212 is connected to the bottom of cold-water inlet tube 195 and fixed by suitable means 89. Manifold 212 is shown inclined so that it is a fixed distance above flange 240. Manifold 212 includes many slits 214 completely along its length. The slits 214 are only in the lower half of the metal tubing forming manifold 212. The slits 214 of manifold 212 are dimensioned and arranged so the cold water flows gently through slits 214 without causing turbulence to the sediment and/or water in tank 140. The slits 214 are perpendicular to the direction of laminar water flow in the annular tube forming manifold 212. One actually built manifold 212 has 48 slits 214, spaced 1 inch from each other along the circumference of the manifold.

In response to water exiting hot water pipe 185, shown by arrow 230, or opening of drain valve 165, cold water enters cold water pipe 195 as shown at arrow 235, causing water to flow from slits 214 to gently wash sediment in tank 140 to the wall of cone 150, thence to the runway that flange 240 forms and to drain 152.

During the cleaning cycle of coils 202 and 314, solenoid valve 304 opens, solenoid valve 303 closes and solenoid valve 305 opens. The cold water enters solenoid valve 304, proceeds through return line 315, through secondary coil 314, through leg 316, through primary coil, to solenoid 305 and out 307 to drain. The cycle would occur from time to time immediately after burner shuts off. A sensor would determine when burner or pump turns off and would send a signal to a pre-programmed timer which would activate the solenoid valves after a predetermined number of heating cycles. The solenoid valves would be activated for a pre-programmed period of time. The process causes the coils to quickly contract, thus causing the hard water scale to dislodge from the inside wall of the coils. When the timer activates all solenoid valves, cold water from the supply line is introduced into the coil, which causes a thermal shock and flushes the sediment out 307 to drain. There are other patents that pump water from a water heater to a filter and back to a water heater, but they do not disclose the cooler water must enter the coil immediately after the burner turns off in order to cause the unit to contract.

In a preferred arrangement an opening is included at the bottom of dip tube 340. This would allow for water to wash the zenith (top of the runway) and cause it to begin a natural slide toward the drain 152. The design also includes an opening 350 (slit or round opening) in the ends of manifold 212, as shown in FIG. 2. The openings 350 would preferably be aimed at drain 152.

This gas water heater has convex top 186 and vertical sides of about 40 inches. The bottom edge of cone 150 at zenith point 222 is about 8 inches below the bottom of flue 210; at nadir 220, the cone bottom edge is about 12 inches below the bottom of flue 210. A 1.5 inch diameter outlet and a 90 degree elbow 155 are connected adjacent to drain 152, at nadir 220 of cone 150. A bell reducer reduces the piping from 1.5 inch diameter to 1.25 inch diameter. Stainless steel ball valve 160 isolates stainless solenoid valve 165 for maintenance or replacement. Tank 140 is about 2 feet in diameter and has a volume of about 33 gallons. Stainless steel inlet dip tube 195 terminates at the 90 degree T 210 about one inch above the bottom edge of cone 150. Three legs support the tank and can therefore accommodate uneven floors. The preferred tank material is stainless steel surrounded by foam insulation and a thin outer metal shell.

The electrical components include solenoid valve 165 and timer and valve controller 170. Timer and valve controller 170 is adjusted to activate solenoid valve 165 for varying durations and frequencies depending on the hardness of the water and amount of particulate residue in the water.

Although the materials referred to for construction are stainless steel, a less expensive heater could be made from a glass-lined carbon steel body using copper pipe and bronze valves.

In one embodiment of the invention as an option, line 311 can be plumbed to all of the hot water taps in a building as a loop, returning to the entrance of the heat exchanger 450. The water is circulated continuously by pump 300 in order to supply instant hot water to all taps in a building. In this embodiment, the burner would be sensitive to the thermostat, but would be unable to turn on unless the flow sensor detected water flow.

In another embodiment of the invention an adjustable burner, pump and flow control valves can be utilized to increase the volume of hot water during periods when high volumes of hot water are desired. The speed of the pump could be increased and a fan would be incorporated into the stack.

In another embodiment of the present invention electrodes 454 can be inserted into the center of the coil to generate an electric arc at a desired height or a Jacobs ladder. This helps eliminate unburned hydrocarbons, increases the efficiency and lowers the emissions. Screens, protruding objects and various types of mixers can be added to create turbulence and mix the air. A transformer energizes the electrodes. A spark distributor can also be utilized to create multiple arcs.

In another embodiment of the present invention the drain pipe is connected to the water reservoir/source of the water heater. It has been noticed that in large capacity water heaters the cleaning cycle needs a good volume of water in the coils and other parts, which goes to waste. The invention recirculates and/or recycles fluids normally lost down the drain. A drain pipe is fitted with a filler 255 (optional) and recirculating/recycling valve 256, through which the water flows to the reservoir or inlet of the water heater.

In yet another embodiment of the present invention is to introduce automatic controls so as to monitor the overflow, overheating, choke in pipeline/disorders, control for timing the heating and cleaning cycle, pump controls etc. The control device comprises of circuits for determining and displaying the temperatures at different sensitive zones, timer circuits to control the timing different cycles and level detectors showing the water level and flow directions and alarms in case of failure at any level. The control circuit includes a memory section for a recordal of previous entries.

In yet another embodiment of the present invention the coil is installed using a method, which would allow it to be removed and replaced easily. This is done utilizing a flange around the top of the cylinder that rests on the top of the flue or by various other methods such as pins etc. Similarly the filters and valves can be dismantled easily in case of repair.

The thermal shock used to clean the coil of the design also works in other water heaters using a coil for continuous flow type water heater such as the Rinnia and Aqua Star brands.

While this invention has been described in terms of several preferred embodiments, there are alterations, permutations, and equivalents, which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A water heater comprising:

a closed tank having a water inlet for connection with a water supply, and a hot water outlet connected to the tank interior;

a flue pipe extending vertically through the tank and having an upper portion for connection with a vent pipe;

a cylinder having a lower open end and an upper end with openings disposed within the flue pipe, and spaced from inner walls of the flue pipe, and extending substantially the length of the flue pipe;

a burner disposed in a lower region of the cylinder and above the lower end thereof, such that combustion products from the burner rise through the cylinder; and a water conducing coil disposed within the cylinder connected with the interior of the tank.

2. The water heater of claim 1 wherein said water conducting coil has an first upper end and first valve means for selectively connecting with the interior of the tank or with the water supply, and a second lower end and second valve means for selectively connecting with the interior the tank or to a drain.

3. The water heater of claim 2 including control means for activating the first and second valve means, such that in one selected activated state heat from the flue pipe is transferred from the coil to the water in the tank, and in another activated state water from the water supply is directed through the coil, immediately after burner shut-off, providing thermal shock to dislodge deposits from the inside walls of the coils for disposing to the drain.

4. The water heater of claim 1 comprising a secondary water conducing coil disposed within the vent pipe, said secondary water conducing coil connected serially with the water conducing coil disposed within the cylinder.

5. The water heater of claim 1, wherein the vent pipe includes a generally horizontal transverse portion, and wherein said secondary water conducing coil is disposed within said transverse portion.

6. The water heater as claimed in claim 4, wherein the transverse section of the vent pipe is slanted downward and includes a drain, for allowing condensate to collect and drain.

7. The water heater as claimed in claim 1, wherein the dimension of the cylinder is selected to provide a space of about 0.25 inches between the cylinder wall and the flue wall.

8. The water heater as claimed in claim 1, wherein the burner is placed about 1 inch above the bottom of the cylinder.

9. The water heater as claimed in claim 1, further comprises heat flow restrictors within the cylinder for increasing contact of combustion gas with the coil to facilitate heat transfer.

10. The water heater as claimed in claim 1, further comprising a pump for circulating water through the coils to prevent overheating of the coils.

11. The water heater as claimed claim 1, wherein the transverse section of the vent pipe is slanted downward causing the condensate to collect at the drain and painted with non-corrosive material to prevent deterioration of the vent pipe.

12. The water heater as claim 1, further comprising a pump, heat exchanger and filter in a line to provide hydronic heating.

13. The water heater of claim 1, further comprising a pump, a thermostat, and a flow sensor, wherein the pump is responsive to the thermostat and the burner is responsive to flow detected by the flow sensor.

14. The water heater as claimed in claim 13, including solenoid valves and a sensor which determines when burner or pump turns off and sends a signal to a pre-programmed timer which activates the solenoid valves after a predetermined number of heating cycles and the solenoid valves are activated for a pre-programmed period of time.

15. The water heater as claimed in claim 1, further comprises electrodes inserted into the center of the coil to generate an electric arc to eliminate unburned hydrocarbons, which increases the efficiency and lowers the emissions.

16. The water heater as claimed in claim 1, further comprises a pump and heat exchanger in a plumbing line loop for providing instant circulating hot water.

17. The water heater as claimed in claim 1, further comprises an adjustable burner, an adjustable pump and flow control valves to allow varying volume of hot water.

18. The water heater as claimed in claim 1, wherein drain pipe is connected to the water reservoir/source of the water heater.

19. The water heater as claimed in claim 18, wherein the drain pipe is fitted with a filter leading to the water reservoir/source of the water heater.

20. The water heater as claimed in claim 1, further comprises of automatic controls so as to monitor the overflow, overheating, choke in pipeline/disorders, control for timing the heating and cleaning cycle, pump controls.

21. The water heater as claimed in claim 1, wherein the coil is adapted for ease of removal and replacement.

22. The water heater as claimed in claim 1, further comprising a condensate trap disposed in the vent pipe and consisting of a perforated funnel with an attached conduit, which allows combustion products to pass and collects condensate for disposal to a drain.

* * * * *